US009399533B2

(12) United States Patent
Paredes et al.

(10) Patent No.: US 9,399,533 B2
(45) Date of Patent: Jul. 26, 2016

(54) BOTTLE HAVING AXIALLY OPPOSED FRUSTOCONICAL PORTIONS

(71) Applicant: Owens-Brockway Glass Container Inc., Perrysburg, OH (US)

(72) Inventors: Raul M Paredes, Perrysburg, OH (US); Douglas Laib, Perrysburg, OH (US); Mindy Paige, Wauseon, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 80 days.

(21) Appl. No.: 13/886,560

(22) Filed: May 3, 2013

(65) Prior Publication Data

US 2014/0326695 A1 Nov. 6, 2014

(51) Int. Cl.
*B65D 1/02* (2006.01)

(52) U.S. Cl.
CPC ..... *B65D 1/0223* (2013.01)

(58) Field of Classification Search
CPC ..... B65D 1/42; B65D 1/0246; B65D 1/02; B65D 1/0223; B65D 1/023; B65D 1/0261; B65D 2501/0081; B65D 2501/0036
USPC ..... 215/382, 379; 220/606
See application file for complete search history.

(56) References Cited

U.S. PATENT DOCUMENTS

| | | | | |
|---|---|---|---|---|
| D52,423 | S | | 9/1918 | Anderson |
| D58,203 | S | * | 6/1921 | Anderson ..... D9/500 |
| D85,233 | S | | 9/1931 | Fuerst |
| D131,470 | S | | 3/1942 | Key |
| D193,032 | S | | 6/1962 | Waser |
| 3,823,032 | A | | 7/1974 | Ukai |
| D272,990 | S | | 3/1984 | Strand |
| 5,158,190 | A | | 10/1992 | Sosenko |
| D419,452 | S | | 1/2000 | DeVore |
| D430,803 | S | | 9/2000 | Reis et al. |
| D434,669 | S | * | 12/2000 | Albright et al. ..... D9/542 |
| D528,000 | S | | 9/2006 | Davis et al. |
| D531,903 | S | | 11/2006 | Haubein |
| D536,616 | S | | 2/2007 | Rubin et al. |
| 7,228,981 | B2 | * | 6/2007 | Chisholm ..... B65D 1/0223 |
| D550,558 | S | | 9/2007 | Van Besien et al. |
| D559,694 | S | | 1/2008 | Le Bras-Brown et al. |
| D564,892 | S | | 3/2008 | di Robilant et al. |
| D572,589 | S | | 7/2008 | Coulis et al. |
| D613,175 | S | | 4/2010 | Delbon |
| D633,793 | S | | 3/2011 | Reagan et al. |

(Continued)

FOREIGN PATENT DOCUMENTS

| | | |
|---|---|---|
| GB | 1074162 A | 6/1967 |
| GB | 1340676 A | 12/1973 |

OTHER PUBLICATIONS

PCT Search Report and Written Opinion, Int. Serial No. PCT/US2014/034279, Int. Filing Date: Apr. 16, 2014, Applicant: Owens-Brockway Glass Container Inc., Mail Date: Jun. 20, 2014.

(Continued)

*Primary Examiner* — Anthony Stashick
*Assistant Examiner* — Raven Collins

(57) ABSTRACT

A bottle extends along a longitudinal axis and includes a base, a body extending from the base, a shoulder extending from the body, and a neck extending from the shoulder and having a neck finish. The body has lower and upper frustoconical portions axially opposed to one another and having straight external surfaces.

15 Claims, 3 Drawing Sheets

(56) References Cited

U.S. PATENT DOCUMENTS

| | | | | |
|---|---|---|---|---|
| D634,206 | S | | 3/2011 | Eisen |
| D639,659 | S | | 6/2011 | Biondich et al. |
| D642,475 | S | | 8/2011 | Crutchley et al. |
| D642,926 | S | | 8/2011 | Jamieson et al. |
| D644,927 | S | | 9/2011 | White et al. |
| D646,977 | S | | 10/2011 | Martin |
| D647,405 | S | | 10/2011 | Lauret |
| D652,723 | S | | 1/2012 | Reisig |
| D658,995 | S | | 5/2012 | Potts |
| D663,625 | S | | 7/2012 | Warneke et al. |
| D666,914 | S | | 9/2012 | Elstow et al. |
| D667,729 | S | | 9/2012 | Nutley et al. |
| D697,804 | S | * | 1/2014 | Hanson ..... D9/500 |
| 2003/0222047 | A1 | * | 12/2003 | McRae ..... 215/373 |
| 2009/0057263 | A1 | * | 3/2009 | Barker et al. ..... 215/381 |

OTHER PUBLICATIONS

EM000289905-0001; European Union design registration; Publication Date May 4, 2005; Owner—Britvic Soft Drinks Limited.

* cited by examiner

BOTTLE HAVING AXIALLY OPPOSED FRUSTOCONICAL PORTIONS

The present disclosure is directed to containers and, more particularly, to bottles.

BACKGROUND AND SUMMARY OF THE DISCLOSURE

Bottles typically include a body, a shoulder, a neck, and a neck finish. U.S. Patent Application Publication 2012/0000878 illustrates an example glass bottle of this general type. Such bottles may be produced using a blow-and-blow manufacturing process, a press-and-blow manufacturing process, or a narrow-neck press-and-blow manufacturing process.

A general object of the present disclosure, in accordance with one aspect of the disclosure, is to provide a bottle that includes a body with axially opposed frustoconical portions for improved ergonomics and label retention, and increased label area.

The present disclosure embodies a number of aspects that can be implemented separately from or in combination with each other.

A bottle extending along longitudinal axis in accordance with one aspect of the disclosure includes a base, a body extending from the base, a shoulder extending from the body, and a neck extending from the shoulder and having a neck finish. The body has a waist, and lower and upper frustoconical portions axially opposed to and spaced apart from one another on either axial side of the waist and having straight external surfaces. The waist sets off the frustoconical portions from one another as two separate and distinctive label panels.

In accordance with another aspect of the disclosure, there is provided a bottle having a body surrounding a central axis, the body having a geometry surrounding the axis that is complementary to a bow tie shape and includes a lower frustoconical portion having one side longer than another side of the lower frustoconical portion, and an upper frustoconical portion having one side that is longer than another side of the upper frustoconical portion, wherein the frustoconical portions have straight external surfaces.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
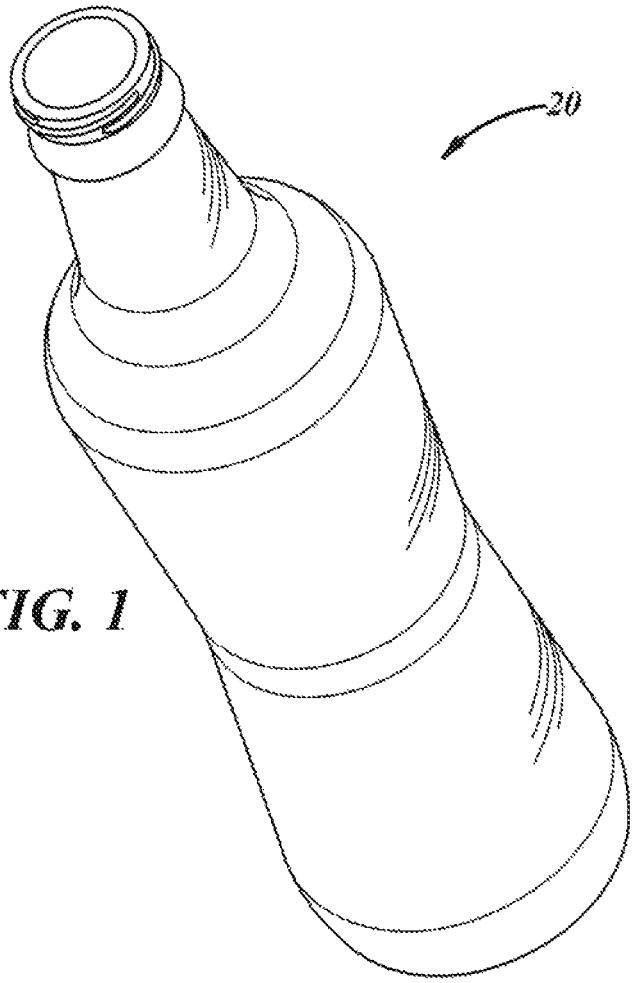
FIG. 1 is a perspective view of a bottle in accordance with an illustrative embodiment of the present disclosure.
Figure 4:
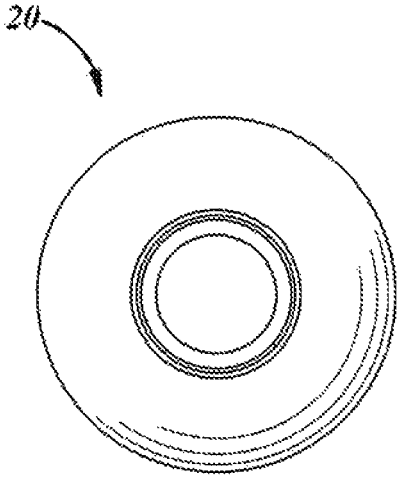
FIG. 4 is a top view of the bottle of FIG. 1.
Figure 2:
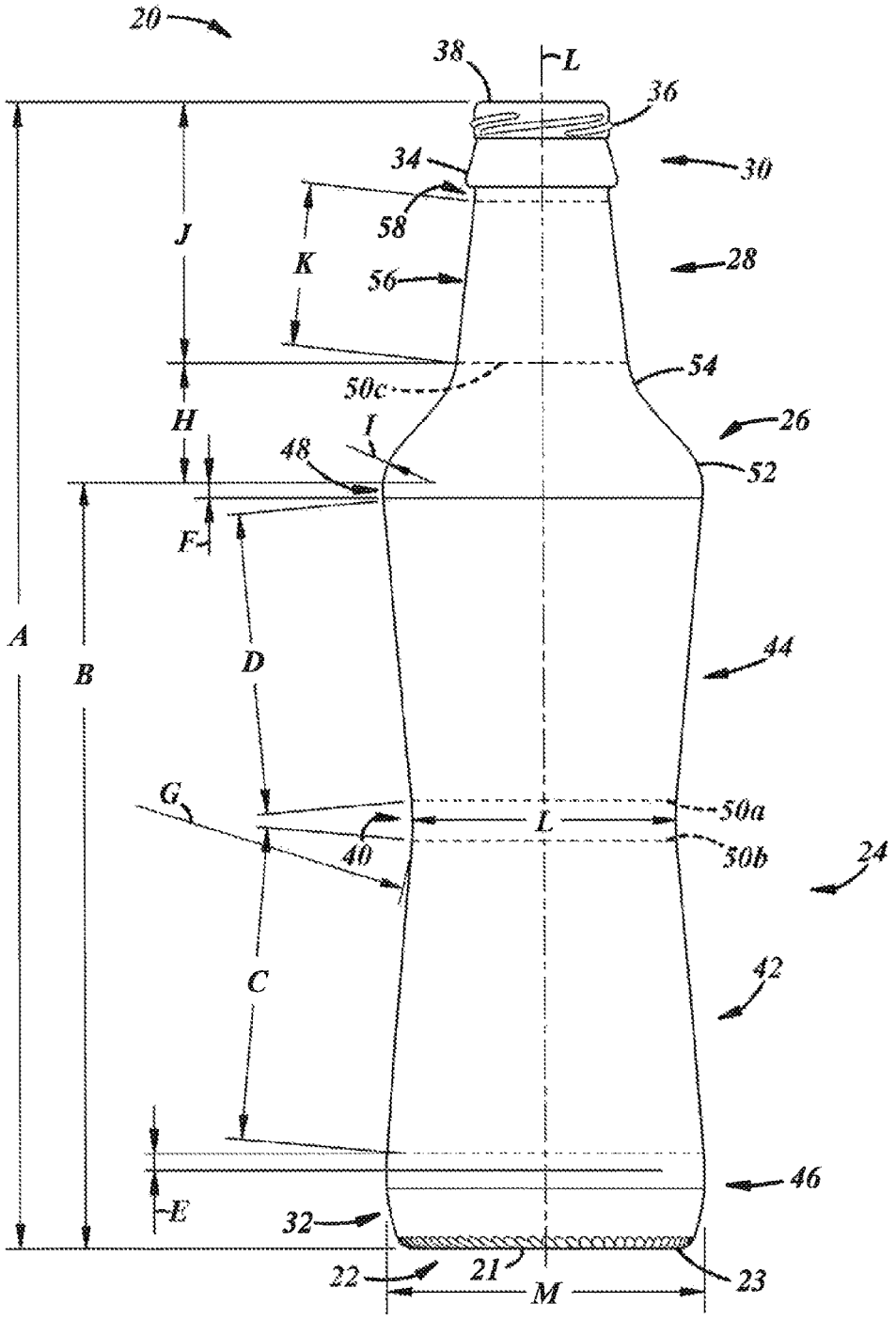
FIG. 2 is a front elevational view of the bottle of FIG. 1.

FIGS. 1 and 2 illustrate a bottle 20 in accordance with one illustrative embodiment of the present disclosure. The bottle 20 extends along a longitudinal central axis Z and may include a closed base 22, a body 24 extending longitudinally from the base 22 at one end of the body 24, a shoulder 26 extending longitudinally and radially inwardly from another end of the body 24, and a neck 8 extending longitudinally from the shoulder 26 and terminating in neck finish 30 axially spaced from the shoulder 26. The bottle 20 may be used for containing a liquid, for example, a beverage, for instance, beer, soda, or any other any suitable beverage.

In one embodiment, the bottle 20 may be a twelve ounce bottle, and may be a narrow neck bottle having a thread diameter (so-called "T" dimension) or a crown diameter (so-called "A" dimension) not more than 38 mm. As used herein, the term twelve ounce narrow neck bottle includes a bottle that has a neck narrower in size than its body and carries, by design intent, twelve ounces of liquid. In other embodiments, the bottle 20 may be a 40 ounce bottle, or a 220, 330, or 750 ml bottle. As will be described in greater detail below, the bottle 20 may include three separate and distinct label areas; on the neck 28 and on the body 24.

Figure 3:
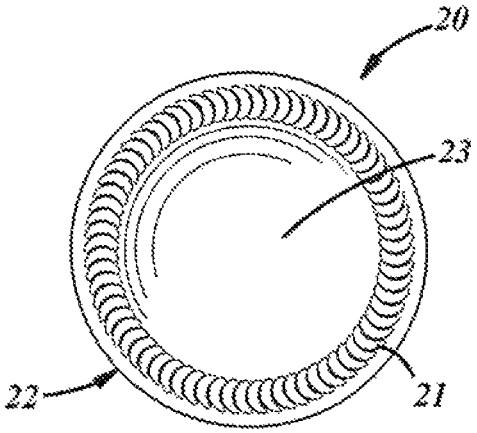
FIG. 3 is bottom view of the bottle of FIG. 1.

With reference to FIG. 3, the base 22 may be circular and may include a rest surface 21 and a central portion 23 disposed radially within the rest surface 21. The rest surface 21 may include circumferentially spaced ribs, and the central portion 23 may include a push-up or raised portion.

With reference to FIG. 2, the base 22 also may include a toe in or heel 32 between the rest surface and the body 24. The heel 32 may be a curved transition zone between the rest surface and the body 24 and may be excurvate in shape. The heel 32 may include a parting line from a seam of a bottom plate and a blow mold (not shown), and an intersection of the body 24 and the heel 32 may be what is known in the art as a contact line or surface.

At the other end of the bottle, the neck finish 30 may be the portion of the bottle 20 that is above a parting line that may be created during manufacturing from a seam of a neck ring and a blank mold (not shown). The neck finish 30 may include a capping flange or collar 34, one or more features 36 for attachment of a closure (not shown), and an axial sealing surface or lip 38. More specifically, and as illustrated, the neck finish 30 may be a threaded finish with a capping flange and one or more closure engagement elements to cooperate with corresponding container engagement elements on a threaded type of twist-off closure (not shown). In other embodiments, the neck finish 30 can instead include a standard finish thereon for engagement with a crimping type of pry-off closure (for example closure 112 in FIG. 5), or any other suitable closure attachment features.

Between the base 22 and the finish 30, the body 24 surrounds the axis Z and includes a waist 40, lower and upper axially opposed frustoconical portions 42, 44 on either axial side of the waist 40, a lower axial spacer portion 46, and an upper axial spacer portion 48. As used herein, the term "frustoconical" includes a conical shape extending along a longitudinal axis and truncated by a plane disposed at any angle non-parallel to the axis and wherein a base of the conical shape may be disposed at any angle non-parallel to the axis. The waist 40 may be the narrowest portion of the body 24, may be a substantially axially central portion of the body 24, and may have an exterior surface that may be incurvate and, more specifically, may be radiused. The waist 40 may be centrally located with respect to the body 24 within plus or minus four percent of the height of the body 24. The lower frustoconical portion 42 may extend between the lower axial spacer portion 46 of the body 24 and the waist 40. Likewise, the upper frustoconical portion 44 may extend between the waist 40 and the upper axial spacer portion 48 of the body 24. The frustoconical portions 42, 44 are circular in cross-section perpendicular to the axis Z. The lower axial spacer portion 46 may be cylindrical, with a straight external surface, and may extend between the heel 32 and the lower frustoconical portion 46. As used herein, the terminology "straight external surface" includes a flat as opposed to curved surface, regardless of whether the surface is cylindrical or frustoconical. The upper axial spacer portion 48 may be cylindrical, with a straight external surface, and may extend between the upper frustoconical portion 44 and the shoulder 26.

Prior unconventional non-cylindrical bottle body designs have surfaces that require use of shrink labels. But the frustoconical portions 42, 44 have straight external surfaces that facilitate ready acceptance and good retention of flat labels, for instance, flat paper or polymeric labels 50*a*, 50*b* that may be partially or fully wrapped around the bottle 20 and may be coupled to the bottle 20 with a pressure-sensitive adhesive backing.

Accordingly, the axially opposed frustoconical portions 42, 44 may establish a quasi hourglass shape. Also, the waist 40 and/or the spacer portions 46, 48 set off the frustoconical portions 42, 44 from one another and/or from the rest of the bottle 20 as distinctive label panels of frustoconical shape.

The straight external surface of the lower frustoconical portion 42 is configured in the form of a taper; decreasing in radial size with distance from the base 22 of the bottle and, thus, the portion 42 faces outwardly at an upward angle. Accordingly, at a point of sale, the label 50*b* applied to that surface will be well lit by overhead lighting, for instance, lights on a ceiling of a store.

Conversely, the straight external surface of the upper frustoconical portion 44 is configured in the form of a reverse taper; increasing in radial size with distance from the base 22 of the bottle 20 and, thus, the portion 44 faces outwardly at a downward angle. Accordingly, at a point of sale, the label 50*a* applied to that surface will be well lit by underneath lighting, for instance, lights on a shelf in a store.

In one embodiment, the frustoconical portions 42, 44 may be substantially symmetrical about a plane bisecting the waist 40 and perpendicular to the axis Z. For example, the height or length of each of the frustoconical portions 42, 44 may be the same or within plus or minus four percent of one another, and the major widths of each of the frustoconical portions may be the same or within plus or minus four percent of one another.

In another embodiment, the frustoconical portions need not be substantially symmetrical. For example, the frustoconical portions may have longer and shorter sides.

The shoulder 26 may include an excurvate portion 52 that extends from the body 24, and an incurvate portion 54 that extends from the excurvate portion 52 to a base of the neck 28. In the illustrated embodiment, the shoulder 26 also includes a straight frustoconical portion between the excurvate and incurvate portions. The excurvate portion 52 of the shoulder 26 may have a relatively tight radius, for instance, 12 to 14 mm.

The neck 28 may include a frustoconical portion 56 extending from the shoulder 26 and, more particularly, extending from the incurvate portion 54 of the shoulder 26. The neck frustoconical portion 56 may terminate at or just below the neck finish 30. For example, the neck 28 may include a cylindrical portion 58 between the neck frustoconical portion 56 and the neck finish 30. The cylindrical portion 58 may include a straight external surface and a neck parting line (not shown). Like the body frustoconical portions 42, 44, the neck frustoconical portion 56 has a straight external surface that facilitates ready acceptance and good retention of a label 50*c*.

The bottle 20 has an overall height A, and the body 24 has a height B, including heights or lengths C, D of the frustoconical portions 42, 44, heights E, F of the spacer portions 46, 48, and the height of the waist 40, which may have a radius G. In illustrative embodiments of the present disclosure, the body height B may be in the range of 58% to 62% of the bottle height A. Also, the combined length C and D of the frustoconical portions 42 and 44 may be in the range of 52% to 56% of the bottle height A. That is in contrast to standard longneck bottles where bottle body label panel heights are typically about 36% of the bottle heights. Accordingly, compared to a standard longneck bottle of similar major diameter and similar volume capacity, the body 24 of the presently disclosed bottle 20 provides an increased label area. For purposes of the present disclosure, the terminology "standard longneck bottle" is defined as a comparison bottle of the same volumetric capacity as the bottle 20 and having a bottle neck height that is at least 30% of the overall bottle height.

The shoulder 26 has a height H that may be in the range of 10% to 12% of the height A of the bottle 20, and the excurvate portion 52 of the shoulder 26 has a radius I that may be less than 40% of the height of the shoulder 26 and less than 15% of the major diameter of the bottle 20.

The neck 28 including the neck finish 30 has a height J that may be in the range of 20% to 24% of the height A of the bottle 20, including a height or length K of the neck frustoconical portion 56 that may be about 12% to 16% of the height A of the bottle 20. The neck 28 may be shorter than that of a standard longneck bottle.

The bottle 20 may have a major diameter M, which may be established by one or both of the portions 46, 48, and the bottle body 24 may have a minor diameter L at the waist 40 that may be 83% to 87% of the major diameter M. The major diameter M may be a standard major diameter for a standard longneck bottle, for example, 2.1 to 2.7 inches, or about 2.4 inches.

Also, the overall height A of the bottle 20 may be the same as an overall height of a standard longneck beverage bottle, for example, 8.7 to 9.3 inches or about nine inches. As used herein, the term "about" includes standard container manufacturing tolerances. The body height B may be 6.3 to 6.9 inches, in contrast to a 4.6 inch body height of a standard longneck bottle.

Compared to a standard longneck bottle, the dimensions and relationships between the dimensions of the presently disclosed bottle 20 enable an increase in label area. For example, the label area of each portion 42, 44 may be 10,269 square millimeters for a total body label area of 20,538 square millimeters. This is in contrast to a body label area of a standard longneck bottle of 16,022 square millimeters, for an increase in body label area of 28%. In any case, the label area of the body 24 may be at least 10%, and preferably at least 20%, greater than a body label area of a standard longneck bottle. The label area of the neck 28 may be smaller than that of a standard longneck bottle, for example, 3,821 square millimeters for the neck 28 in contrast to a neck label area of a standard longneck bottle of 5,734 square millimeters.

The bottle 20 may be of one-piece integrally formed construction, for, example, of glass, ceramic, metal, or plastic construction. (The term "integrally formed construction" does not exclude one-piece integrally molded layered glass constructions of the type disclosed for example in U.S. Pat. No. 4,740,401, or one-piece glass or metal bottles to which other structure is added after the bottle-forming operation.) Glass bottles can be fabricated by press-and-blow, blow-and-blow, or narrow-neck press-and-blow manufacturing operations, or by any other suitable technique(s). The body may be formed by incorporating corresponding features in blow molds.

Figure 5:
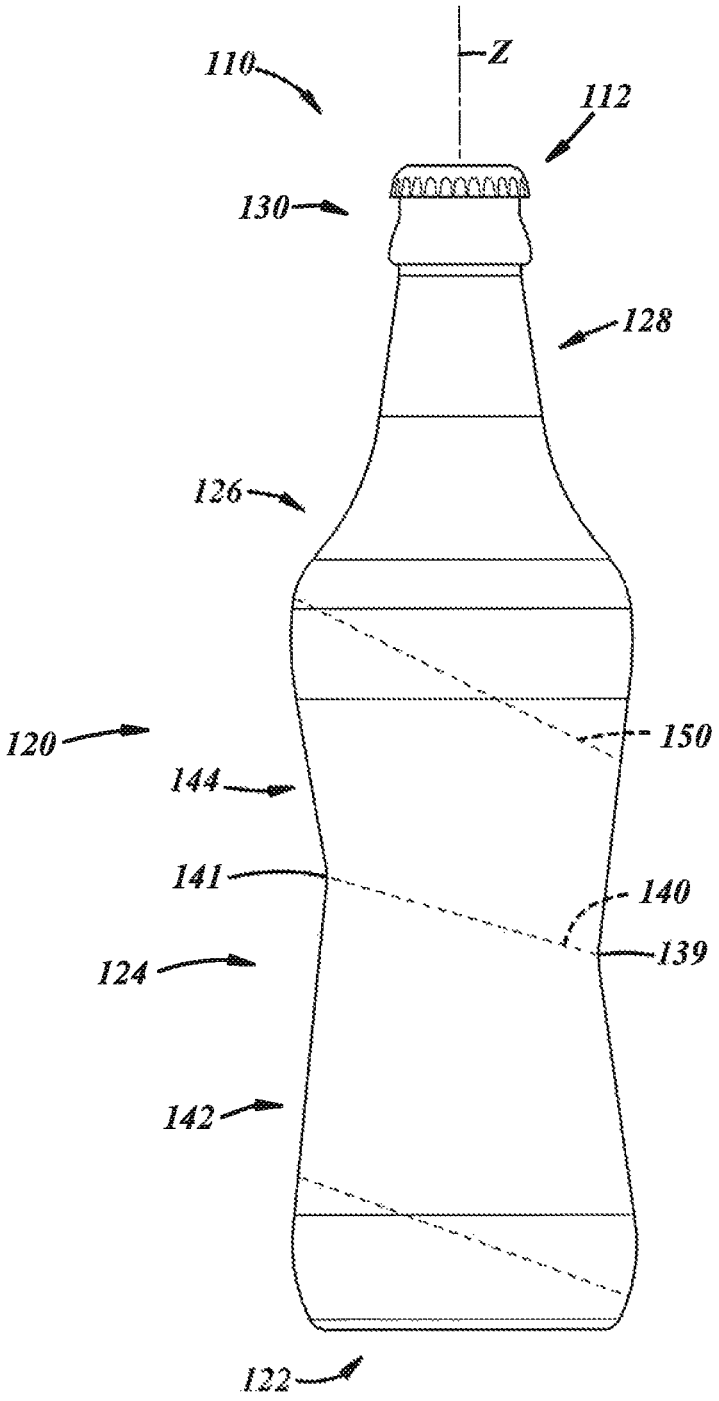
FIG. 5 is a front devotional view of a bottle in accordance with another illustrative embodiment of the present disclosure.

FIG. 5 shows another illustrative embodiment of a bottle 120. This embodiment is similar in many respects to the embodiment of FIGS. 1-4 and like numerals among the embodiments generally designate like or corresponding elements throughout the several views of the drawing figures. Accordingly, the descriptions of the embodiments are incorporated into one another, and description of subject matter common to the embodiments generally may not be repeated here.

The bottle includes a closed base 122, a body 124 surrounding an axis Z, a shoulder 126, and a neck 128 terminating in neck finish 130. The bottle is part of a package 110 including a closure 112 coupled to the neck finish 130 in any suitable manner.

In this embodiment, the body 124 may comprise two conic sections integrally connected to each other at a narrow waist 140. The waist 140 is disposed in a plane at a non-zero angle with respect the axis Z, such that one side (or partially circumferential portion) of a lower frustoconical portion 142 of the body 124 is longer than another side (or partially circumferential portion) of the lower frustoconical portion 142, and one side (or partially circumferential portion) of an upper frustoconical portion 144 of the body 124 is longer than another side (or partially circumferential portion) of the upper frustoconical portion 144. For example, an index finger on a user's hand may grip a low side 139 of the waist 140 and a thumb of the user's hand may grip a high side 141 of the waist 140.

Also in this embodiment, the body 124 has a body geometry surrounding the axis Z that may be complementary to a bow tie shape that may be carried by the body 124, and also may have an embossment or a debossment of an external surface of the body 124, or labeling printed on or secured to the external surface of the body 124. For example, the bottle 120 may accept a shrink label 150 carried by and between the frustoconical portions 142,144. The hourglass shape of the frustoconical portions 142, 144 may aid in preventing the shrink label 150 from sliding up or down relative to the body 124 and, thus, may aid in retaining the label 150 to the body 124. The same applies to the embodiment of FIGS. 1-4.

There thus has been disclosed bottles that fully satisfy one or more of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A bottle extending along a longitudinal axis and that includes,
- a base;
- a body extending from the base;
- a shoulder extending from the body; and
- a neck extending from the shoulder and having a neck finish;
- the body having:
  - a waist, and
  - lower and upper frustoconical portions axially opposed to and spaced apart from one another on either axial side of the waist and having straight external surfaces and being circular in cross-section perpendicular to the longitudinal axis,
  - the waist setting off the frustoconical portions from one another as two separate and distinctive label panels,
  - wherein a height of the body is in the range of 58% to 62% of an overall height of the bottle and a combined length of the frustoconical portions is in the range of 52% to 56% of the overall height of the bottle.

2. The bottle set forth in claim 1, wherein the neck includes a frustoconical portion having a straight external surface to establish a third label panel.

3. The bottle set forth in claim 1, that includes the base having a toe in from which the body extends and the body further having:
- a lower axial spacer portion between the lower frustoconical portion and the toe in of the base, and
- an upper axial spacer portion between the upper frustoconical portion and the shoulder,
- the spacer portions further setting off the frustoconical portions from the rest of the bottle as distinctive label panels.

4. The bottle set forth in claim 3, wherein the neck includes a frustoconical portion having a straight external surface to establish a label panel, such that the bottle includes three separate and distinct label panels of frustoconical shape.

5. The bottle set forth in claim 3, wherein the toe in is excurvate and the lower axial spacer portion is cylindrical with a straight external surface.

6. The bottle set forth in claim 3, wherein the upper axial spacer portion is cylindrical with a straight external surface and the shoulder has an excurvate portion extending from the upper axial spacer portion.

7. The bottle set forth in claim 6, wherein the excurvate portion of the shoulder has a radius of less than 40% of the height of the shoulder and less than 15% of a major diameter of the bottle.

8. The bottle set forth in claim 6, wherein the shoulder has an incurvate portion extending from the excurvate portion of the shoulder and the neck has a frustoconical portion extending from the incurvate portion and including a straight external surface to establish a third label panel.

9. The bottle set forth in claim 1, wherein the waist is disposed in a plane perpendicular to the axis and is incurvately shaped with a radius.

10. A bottle extending along a longitudinal axis and that includes,
- a base;
- a body extending from the base;
- a shoulder extending from the body; and
- a neck extending from the shoulder and having a neck finish;
- the body having:
  - a waist, and
  - lower and upper frustoconical portions axially opposed to and spaced apart from one another on either axial side of the waist and having straight external surfaces,
  - the waist setting off the frustoconical portions from one another as two separate and distinctive label panels, wherein the waist is disposed in a plane at a non-zero angle with respect the axis, such that one side of the lower frustoconical portion is longer than another side of the lower frustoconical portion and one side of the upper frustoconical portion is longer than another side of the upper frustoconical portion.

11. The bottle set forth in claim 1, wherein the bottle is composed of glass and the frustoconical portions carry separate flat labels.

12. The bottle set forth in claim 10, wherein the bottle is composed of glass, and a shrink label is carried by and between the frustoconical portions.

13. A bottle having a body surrounding a central axis, the body having a geometry surrounding the axis that is complementary to a bow tie shape and includes a lower frustoconical portion having one side longer than another side of the lower frustoconical portion, and an upper frustoconical portion having one side that is longer than another side of the upper frustoconical portion, wherein the frustoconical portions have straight external surfaces and wherein the frustoconical portions are integrally connected to each other at a narrow waist that lies in a plane at a non-zero angle to the axis.

14. The bottle set forth in claim 13 wherein the body is quasi hourglass-shaped.

15. The bottle set forth in claim 1, wherein the overall height of the bottle is 8.7 to 9.3 inches.

* * * * *